United States Patent [19]

Sachleben, Sr. et al.

[11] 4,057,910

[45] Nov. 15, 1977

[54] EXHAUST QUENCH AIR DIFFUSER

[75] Inventors: Harold Gerard Sachleben, Sr., Bellmawr, N.J.; Jerry Jay Warren, Richmond, Va.

[73] Assignee: Allied Chemical Corporation, Morris Township, N.J.

[21] Appl. No.: 699,917

[22] Filed: June 25, 1976

[51] Int. Cl.[2] ..... F26B 13/24; B29B 3/00

[52] U.S. Cl. ..... 34/227; 425/72 S; 425/72 R; 34/232; 34/DIG. 8; 432/77

[58] Field of Search ..... 34/227, 229, 232, DIG. 8; 432/77-79, 85; 266/259; 425/72 R, 73, 72 S; 264/180, 181

[56] References Cited

U.S. PATENT DOCUMENTS

| | | | |
|---|---|---|---|
| 2,245,308 | 6/1941 | Thalmann | 425/72 R |
| 2,252,684 | 8/1941 | Babcock | 425/72 S |
| 3,508,296 | 4/1970 | Toshiroono | 425/72 S |
| 3,999,909 | 12/1976 | Schippers | 428/72 S |

*Primary Examiner*—John J. Camby
*Assistant Examiner*—Henry C. Yuen
*Attorney, Agent, or Firm*—Richard A. Anderson

[57] ABSTRACT

This invention is an apparatus for diffusing quench air at the exhaust of the air from a quench stack for cooling synthetic melt-spun fibers, comprising a series of slats arranged peripherally around the fibers in the quench stack.

5 Claims, 2 Drawing Figures

EXHAUST QUENCH AIR DIFFUSER

BACKGROUND OF THE INVENTION

This invention relates to melt spinning of synthetic fiber, filaments, yarn, ribbon and other extruded shapes when a quench stack is used. Particularly, this invention relates to the diffusion of quench air at the exhaust portion of the quench stack for quenching melt-spun synthetic fiber and the like. A typical quench stack is shown in U.S. Pat. No. 2,252,684 with diffusion at the exhaust portion shown at the bottom of FIG. 1 and FIGS. 2–4. Another known apparatus surrounded the freshly spun fiber or yarn with expanded metal covered with wire mesh, at the exhaust portion of the quench stack. This prior art apparatus improperly diffused the air around the freshly spun yarn because it did not allow for different flow rates of the air near the air exhaust as opposed to further from the air exhaust. Also, the wire mesh became blocked by loose yarn filaments.

SUMMARY OF THE INVENTION

The apparatus of this invention proportions the amount of air exhausted from a specific location around the periphery of the quench stack so there is very little movement of the yarn resulting from the flow of exhausting air. Also the unit does not become blocked by loose yarn filaments assuring a better quality yarn product.

This invention is an apparatus for diffusing quench air at the exhaust of the air from a quench stack for cooling synthetic melt spun fibers. The stack has an exhaust outlet in an exhaust portion of the stack. The apparatus comprises a series of slats arranged peripherally between the fibers and the quench stack in the exhaust portion of the quench stack. The slats are arranged to have gaps between the slats of varying width. The variation in width is to create gaps wider around the circumference, near the air exhaust of the quench stack and correspondingly narrower around the circumference away from the air exhaust of the quench stack. Also, the gaps can be narrower toward the air flow.

The slats, and therefore the gaps between, which diffuse the air can be arranged either parallel or normal to the flow of air which is also the direction of movement of the fiber or yarn in the quench stack. The slats and therefore the gaps therebetween can also be tapered to achieve the desired variance in the gaps set forth above.

This invention has the following benefits:

1. There is significantly less yarn movement, thereby improving the uniformity and quality of the yarn.
2. There is no blockage by the apparatus of the loose yarn filaments as occurs when wire mesh is used.
3. Maintenance is reduced since less frequent cleaing of the wire screen is necessary.
4. Maintenance is reduced because the apparatus needs replacement or repair far less often as compared to the wire screen apparatus.

DESCRIPTION OF THE PREFERRED EMBODIMENTS

Figure 1:
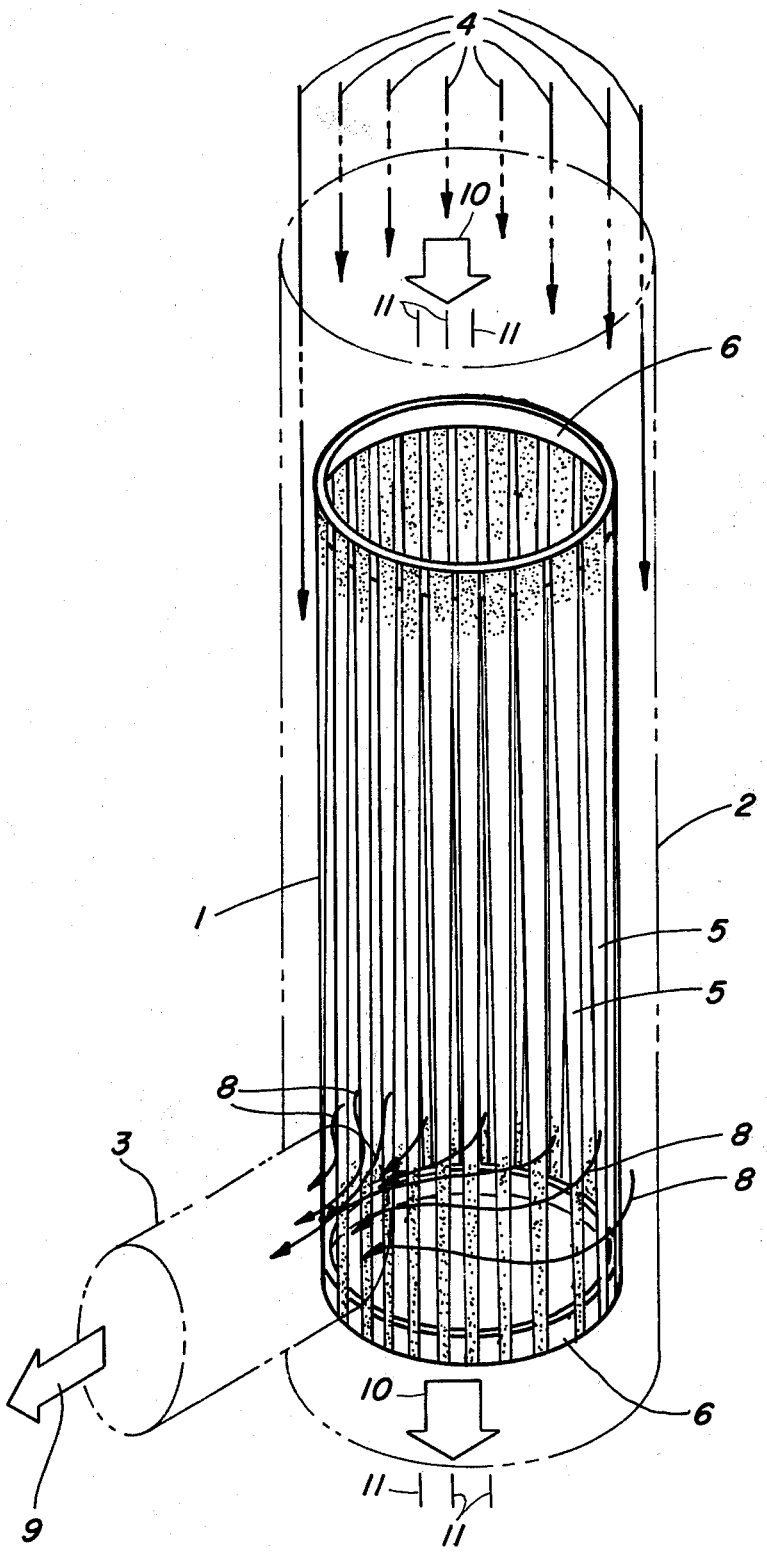
FIG. 1 is an isometric view showing the apparatus of this invention in place in a quench stack.

In FIG. 1 diffuser 1 is shown in place in quench stack 2 having air exhaust 3. Arrows 4 show direction of the quench air flow, coming from above down the stack. Slats 5 of the diffuser 1 are attached to end rings 6 at each end of the apparatus. Diffusion of the quench air is shown by arrows 8 showing the direction of the air flow in the stack at the exhaust Arrow 9 shows direction of the air flow out of the exhaust. Note this embodiment shows slats 5 tapered, and placed parallel to the flow of quench air.

Arrow 10 show the direction of yarn 11 passing through the quench stack.

Figure 2:
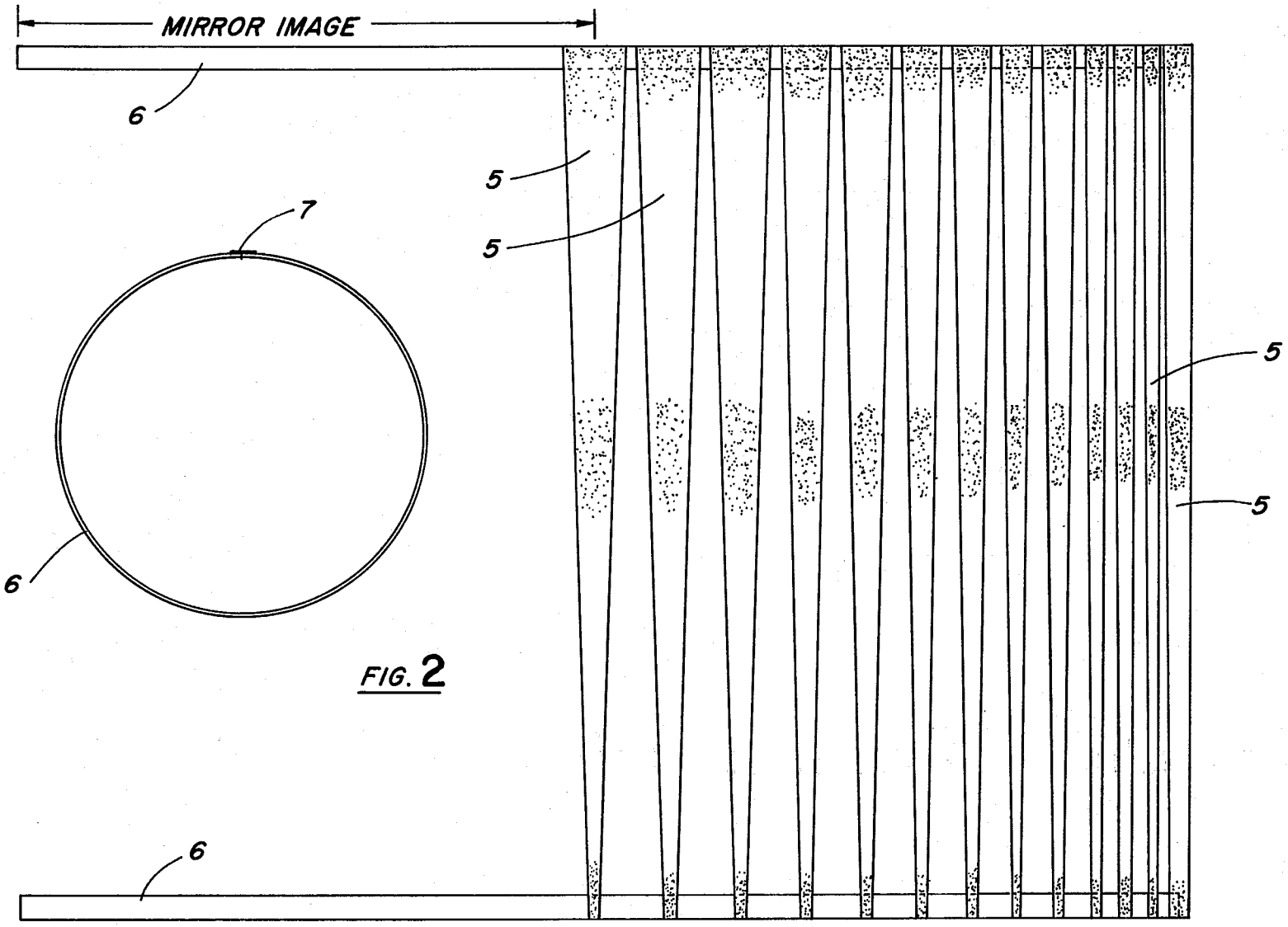
FIG. 2 shows the lay-out for the tapered slats and end rings for the apparatus of this invention, in a spread out condition, and the connector in place on a closed-up end ring.

In FIG. 2 the tapered slats 5 are shown laid out in expanded view connected to rings 6. The other half of the apparatus is a mirror image as shown in the drawing. End ring 6 is connected by an end ring connector 7 when the apparatus is assembled and ready for use, as shown.

EXAMPLE

In operation diffuser 1 is in position in quench stack 2 with quench air flowing downward as shown by arrows 4. In order to avoid confusion in the drawing and for the sake of clarity, the yarn 11 is not shown in the diffuser. However, quench yarn will move through the center of diffuser 1 between rings 6 at top and bottom and will move downward from bottom of ring 6. Polycaprolactam is melt extruded at a temperature of about 260° C. under a pressure of about 3,500 psig through a multi-orifice spinnerette assembly. The filaments will become solid at a point above the diffuser 1 by being cooled by quench air. As the filaments pass through diffuser 1 between end rings 6 quench air is exhausted as shown by arrows 8 and 9 through exhaust 3. The filaments of yarn will continue on through quench stack 2 out at the bottom and would be taken up on conventional suitable take-up means not shown. No movement of the yarn is observed as is caused by the exhaust of air through exhaust 3, in the prior art apparatus.

We claim:

1. An apparatus for diffusing flowing quench air at the exhaust of said air from a quench stack for cooling moving synthetic melt-spun fibers, said stack having an exhaust outlet in an exhaust portion of said stack, comprising a series of slats arranged peripherally between said fibers and said quench stack in said exhaust portion, said slats being spaced apart to each other and form a plurality of gaps between said slats varying in width, said variation in width of said gaps being wider around the circumference nearer said air exhaust outlet of said quench stack and correspondingly being narrower around the circumference away from said air exhaust outlet of said quench stack.

2. The apparatus of claim 1 wherein said slats are tapered.

3. The apparatus of claim 1 wherein said slats are arranged peripherally parallel to the flow of said quench air and said fibers in said quench stack.

4. The apparatus of claim 2 wherein said slats are arranged peripherally parallel to the flow of said quench air and said fibers in said quench stack.

5. The apparatus of claim 4 wherein said slats are tapered to have gaps narrower toward said air flow.

* * * * *